US005145135A

United States Patent [19]

Thompson

[11] Patent Number: 5,145,135

[45] **Date of Patent: * Sep. 8, 1992**

[54] OBJECT SUPPORT RACK

[75] Inventor: Alex Thompson, Manhattan Beach, Calif.

[73] Assignee: Russel L. Thompson, Manhatten Beach, Calif.

[ * ] Notice: The portion of the term of this patent subsequent to Feb. 20, 2004 has been disclaimed.

[21] Appl. No.: 475,379

[22] Filed: Feb. 5, 1990

[51] Int. Cl.[5] ..... A47F 7/00

[52] U.S. Cl. ..... 248/201; 211/60.1

[58] Field of Search ..... 248/912, 538, 65, 201, 248/304, 305, 309.2; D6/552, 553; 224/42.03 B, 42.45 R; 211/7, 18, 60.1, 105.1

[56] References Cited

U.S. PATENT DOCUMENTS

| | | | |
|---|---|---|---|
| D. 172,771 | 8/1954 | Terrell | D6/553 |
| D. 217,516 | 5/1970 | Wells | D6/553 |
| D. 245,652 | 9/1977 | Crysdale | D6/553 |
| 252,940 | 1/1882 | Hayden | 248/304 |
| D. 276,195 | 11/1984 | Smith | D6/553 |
| D. 306,110 | 2/1990 | Thompson | D6/553 |
| 1,598,727 | 9/1926 | Jones | 211/60.1 |
| 2,432,732 | 12/1947 | DelCano | 224/42.03 B |
| 2,523,951 | 9/1950 | Graumlich | D6/523 |
| 3,164,255 | 1/1965 | Jay | 211/60.1 |
| 3,493,202 | 2/1970 | Jensen | 248/53 B |
| 3,701,436 | 10/1972 | Adams | 248/201 |
| 4,108,313 | 8/1978 | Bogar, Jr. | 224/42.45 R |

*Primary Examiner*—Ramon O. Ramirez
*Assistant Examiner*—Robert A. Olson
*Attorney, Agent, or Firm*—Robert J. Schaap

[57] ABSTRACT

An object support rack comprising a plate adapted for engagement on a wall or other similar relatively flat surface and preferably a vertically disposed surface. The plate of the object support rack has a socket which receives a post. This post may extend angularly outwardly from the plate of the object support rack. In addition, elbows may be provided for changing the angulated position of a portion of the post with respect to the object support rack. A plurality of the object support racks may be mounted in abutting relationship or otherwise, a closely spaced apart relationship on the wall for supporting the plurality of objects. Foam covers extend over the posts and also can extend over a portion of the plates to protect the objects supported thereon. Moreover the object support racks can be mounted essentially in any position on a wall, depending upon the objects which are to be supported.

22 Claims, 6 Drawing Sheets

OBJECT SUPPORT RACK

BACKGROUND OF THE INVENTION

1. Field of the Invention

This invention relates in general to certain new and useful improvements in object supports racks and more particularly, to an improved object support rack which can be mounted in a wide variety of positions on a wall and each of which has posts extending outwardly therefrom and which can be angulated in a variety of positions with respect to the wall and further where the object support racks can be used in tandem.

2. Brief Description of the Prior Art

There is a large need for object support racks, primarily for displaying various types of objects in promotional activities, particularly at points of sale. Object support racks also find widespread use and need in dwelling structures of individuals, primarily for purposes of storage. There are no effective object support racks which are universally designed to support a large number of objects of different sizes and shapes.

In the case of product merchandising, most retailers of products rely upon conventional wall brackets which are not only unattractive, but have limited versatility. A typical wall bracket generally includes a flange for engagement against the surface of a wall and an outwardly extending angularly struck arm, the latter of which is used to hold an object. However, these brackets are not typically designed for support of various objects and are only used in the absence of a generally versatile wall mounting support.

There are very few object support racks which are available for use in personal home dwelling structures. The individual often has a need to store numerous objects in order to preclude a consumption of valuable floor space. Here again, the only available mechanism for storage is the typical L-shaped brackets which are large and obtrusive and more importantly, they are very unsightly.

It is preferable to mount objects, such as items offered for sale, on a wall surface as opposed to a floor in order to conserve floor space. Moreover, wall mounted objects are more visible and this eliminates a need for additional space by a retailer or other seller of merchandise.

However, it is important to provide an object support rack which is capable of providing support for a large number of differently sized and shaped objects. As a simple example, in a sporting goods store, it may be necessary to support surf boards which have a wide surface area and are relatively thin and it may also be necessary to support bicycles on racks. In like manner, it may be necessary to support skiis or similar objects on wall mounted racks. Thus, there is clearly a need for a highly versatile object support rack and which does not require a plurality of different sized racks with one for each type of object to be supported.

There have been various types of devices for holding objects. However, they are not universally adaptable for supporting a wide variety of objects. As a simple example, U.S. Pat. No. Des. 172,771 includes a bracket with outwardly extending posts for holding records. In like manner, U.S. Pat. No. Des. 202,520 discloses a bracket also capable of being mounted on a wall for supporting an object. U.S. Design Pat. No. Des. 217,516 discloses a bracket mounted on a wall for holding a wig. Further, U.S. Pat. No. 2,523,951 discloses a toilet paper holder which is also mounted on a wall. However, each of these object support racks, as indicated, have limited use and are virtually specific to a particular purpose and object only.

OBJECTS OF THE INVENTION

It is, therefore, a primary object of the present invention to provide an object support rack which is capable of supporting a variety of differently sized and shaped objects.

It is another object of the present invention to provide an object support rack of the type stated which has a wall engaging surface of configuration and sufficient size so that it can be secured to a plaster or plasterboard wall with conventional fasteners such as screws and the like and where a load is supported thereon in such manner that anchors and other forms of mechanical fasteners are not required.

It is a further object of the present invention to provide an object support rack of the type stated which can be secured to a wall either right side up or in an upside down condition or in numerous other conditions as for example, a horizontally disposed condition, for supporting differently sized and shaped loads.

It is an additional object of the present invention to provide an object support rack of the type stated in which a supporting post thereon can be located in a variety of angular positions in order to support different types of loads.

It is another salient object of the present invention to provide a system of object support racks in which a plurality of these support racks are located in abutting or in closely spaced relationship to one another in order to hold a large quantity of thin flat objects in a relatively small amount of space.

It is still a further object of the present invention to provide an object support rack of the type stated which utilizes retaining cable extending from adjacent object support racks for retaining objects on the support racks;

It is still another object of the present invention to provide an object support rack of the type stated which is highly effective in use, versatile and relatively inexpensive to manufacture.

With the above and other objects in view, my invention resides in the novel features of form, construction, arrangement and combination of parts presently described and pointed out in the claims.

BRIEF SUMMARY OF THE INVENTION

A wall mountable object support rack for releasably supporting an object thereon. The present object support rack is capable of supporting a large number of objects of differing sizes and shapes as for example, bicycles, surf boards and the like. Thus, the object support rack of the present invention is highly effective as a display rack.

The object support rack, in one embodiment, comprises a plate having a wall engaging surface capable of being disposed against a wall so that the plate can be substantially vertically disposed. A post is secured to the plate and extends outwardly at an angular relationship so that the post is held in other than a perpendicular relationship with respect to the plate.

In this embodiment of the object support rack, a plurality of fastener receiving apertures are formed in the plate and one of these apertures is adjacent to an upper edge of the plate and another of these apertures is adjacent to a lower edge of the plate. Thus, mechanical fasteners, such as screws or the like may extend through the apertures for securing the plate to a wall, such as a plaster wall, or a plasterboard wall, or other type of wall.

The rack is formed with a wall engaging edge extending around the entire periphery thereof. Moreover, the entire surface of the rack is sufficiently large so that there is a substantial wall surface and support rack surface contact. In this way, there is a sufficiently greater surface area contact than would be available with a towel rack or the like.

The post is at an angle with respect to the apertures so that a load may be effectively carried at the apex of the angle between the post and the plate. The post is designed to extend outwardly from the plate at an angle varying from between about 15 degrees to about 40 degrees. In this way, the object support rack can be secured to plaster or plasterboard walls with screws and without anchors and where a rack having a plate and a perpendicularly arranged arm would not support an object of equal weight if secured by screws. It is theorized that the large surface area contact between a wall surface and the wall engaging surface of the support rack along with the unique construction and the arrangement of the post enables the support rack to be securely affixed to a plaster wall or a plasterboard wall without the need of conventional anchors and the like.

It has been found in connection with the present invention that a peripheral dimension of at least about 13 inches is highly effective for use in enabling the support rack to be secured to a plaster or plasterboard wall with conventional fasteners. More preferably, the peripheral dimension which generally includes the dimension on the wall engaging surface should be at least 16 inches.

In another embodiment of the invention, a foam pad extends entirely over the post. A second foam pad is on a portion of the plate at a region where an object might otherwise contact the plate so that an object supported on the object support rack will be protected against scratches or abrasions by the pad on the post and the pad on the plate.

In still another aspect of the invention, a raised surface is formed on the plate and is preferable integrally formed with the plate. This raised surface is located at an angular relationship with respect to the plate so that the post is perpendicular to the raised surface. Inasmuch as the raised surface is at an angular relationship with respect to the plate, the post will also be at an angular relationship other than perpendicular with respect to the plate.

In another embodiment of the invention, the object support rack is provided with an outwardly extending socket and this socket is preferably located on the raised surface. The post has an end which is adapted to fit within the socket to be retentively held therein. Means may be associated with the socket and the end of the post so that the post can be releasably locked within the socket. Removal of an object from the object support rack will not cause an inadvertent removal of the post from the socket.

In another embodiment of the invention, the plate with the post secured thereto may be mounted in a right side up position or otherwise, it may be mounted in an upside down position. In either case, the post is capable of supporting a first object in one position and another object in the other position. In addition, an elbow may be adapted for connection to an opposite or outer end of the post. A second post is then provided for securement to the elbow so that it may extend outwardly with respect to the first post and in an angular relationship with respect to the first post.

In accordance with the above-identified construction, it can be seen that the plates can be mounted in a variety of positions and moreover, the posts can assume a variety of angular relationships with respect to the plates. In addition, different sized posts may be used. Accordingly, the object support rack of the present invention has a wide degree of utility and is capable of being used in a large number of environments.

In another aspect of the invention, there is provided a system of object support racks for releasably supporting a plurality of objects and with each rack capable of supporting separate objects. In this case, means is associated with each of the plates in order to enable the plates to be secured to a wall surface an in the position where they are vertically disposed relative to one another. In like manner, a post is secured to and extends outwardly from each of the plates at an angular relationship other than perpendicular with respect to the plates. The same pad extends around the posts of each plate and an insert pad is adapted for securement to a post on one plate and is also adapted for engagement by the next adjacent and abutting plate. In accordance with the above construction, an object supported on the object support rack will not be marred or scratched by the rack In still another aspect of the invention, a series of small retaining cables such as ropes and the like may be connected between the various adjacent racks. More preferably, a cable is secured to the outer end of each of the posts in this embodiment and the cable is provided at its free end with a hook for securement either to an object or to an opposite post or support rack. In this way, objects which might otherwise fall from the support rack can be retentively held thereon until the cables are released.

This invention possesses many other advantages and has other purposes which may be made more clearly apparent from a consideration of the forms in which it may be embodied. These forms are shown in the drawings forming a part of and accompanying the present specification. They will now be described in detail for the purposes of illustrating the general principles of the invention, but it is to be understood that such detailed description is not to be taken in a limiting sense.

BRIEF DESCRIPTION OF THE DRAWINGS

Figure 1:
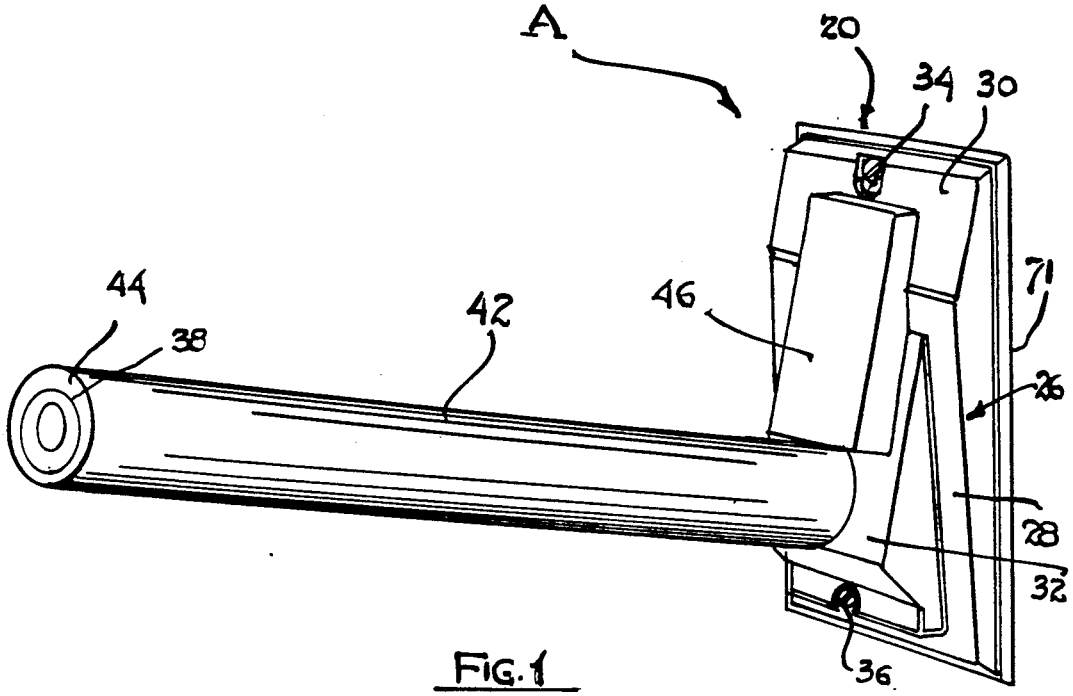
Figure 2:
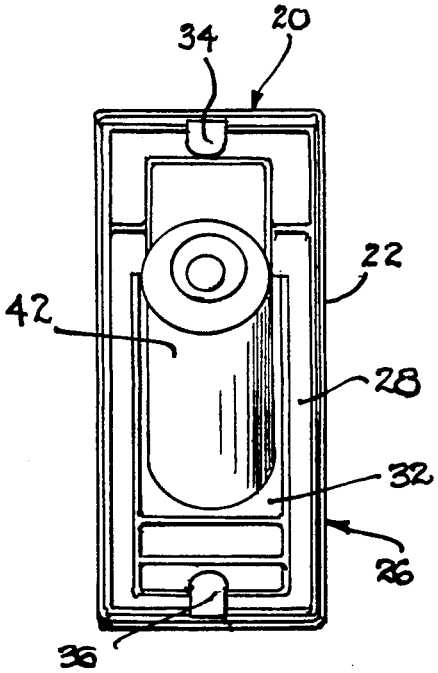
Figure 3:
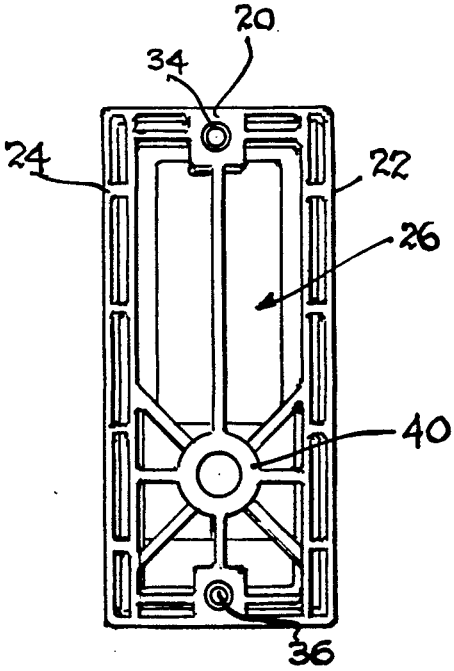
Figure 4:
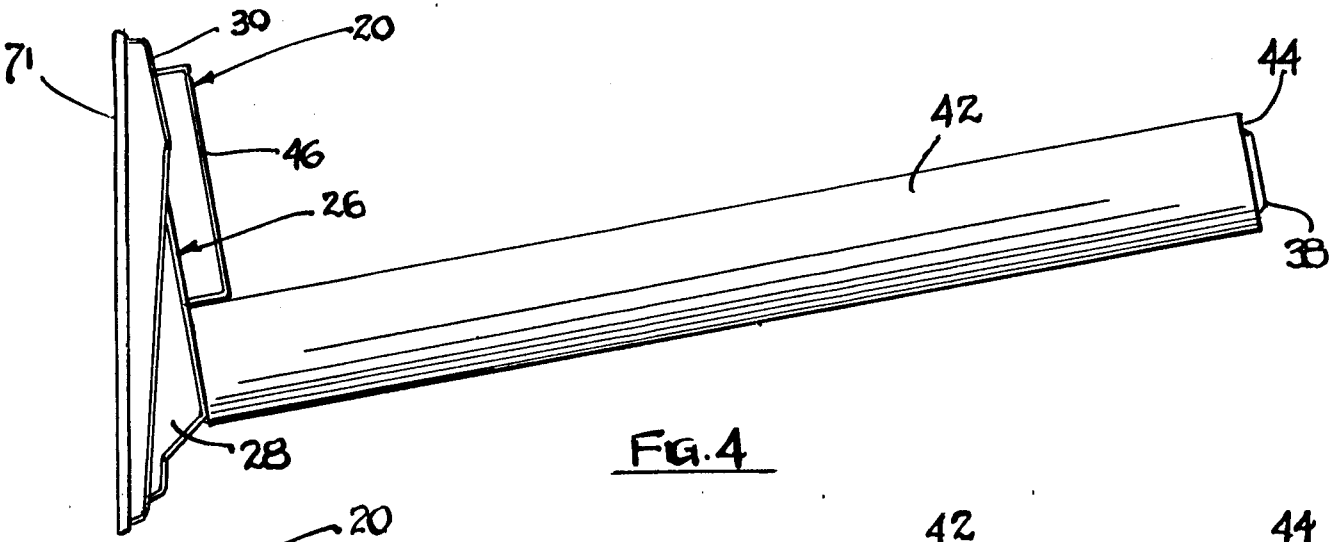
Figure 5:
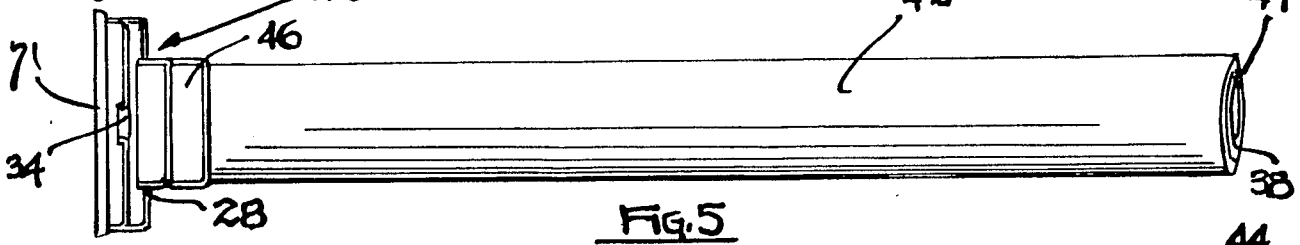
Figure 6:
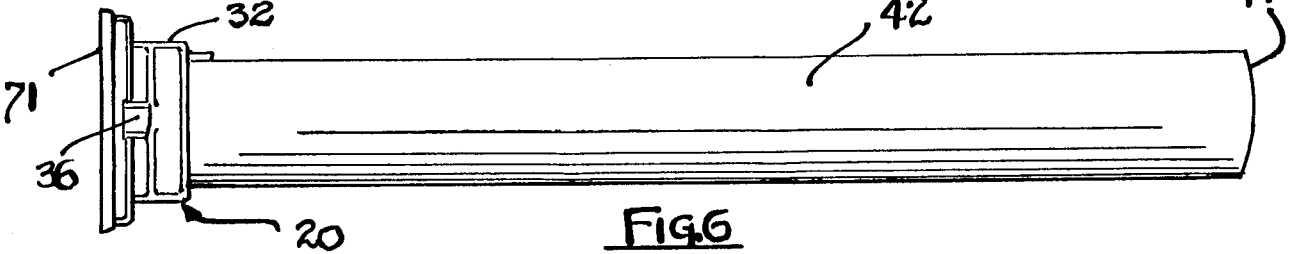
Figure 7:
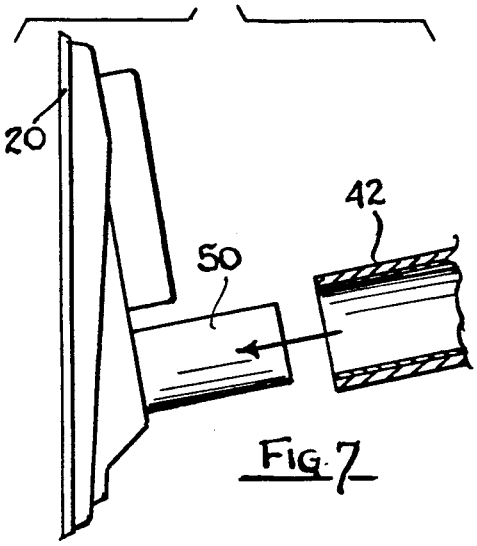
Figure 8:
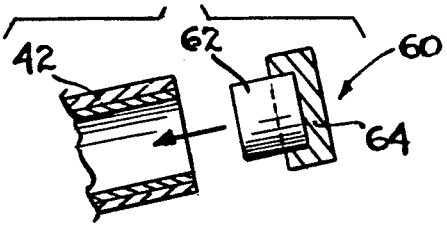
Figure 9:
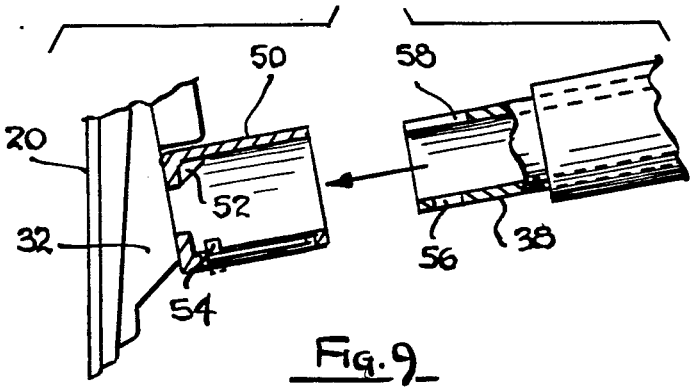
Figure 10:
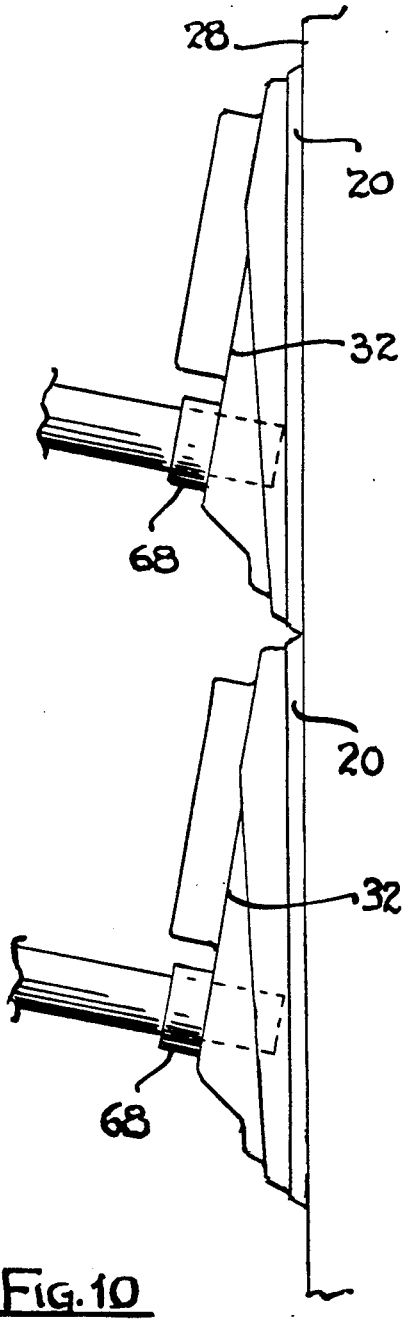
Figure 11:
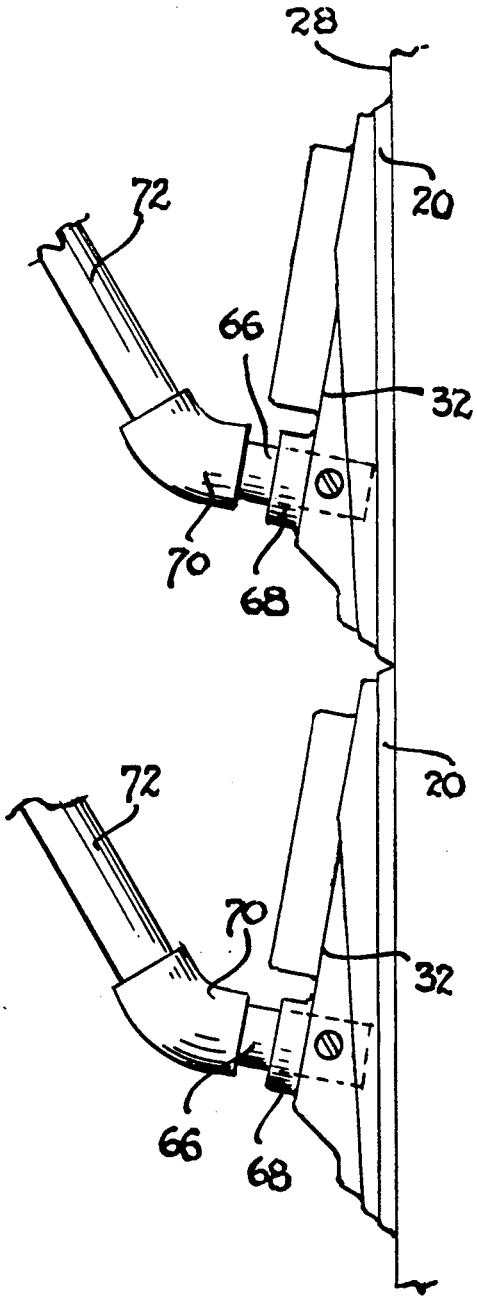
Figure 12:
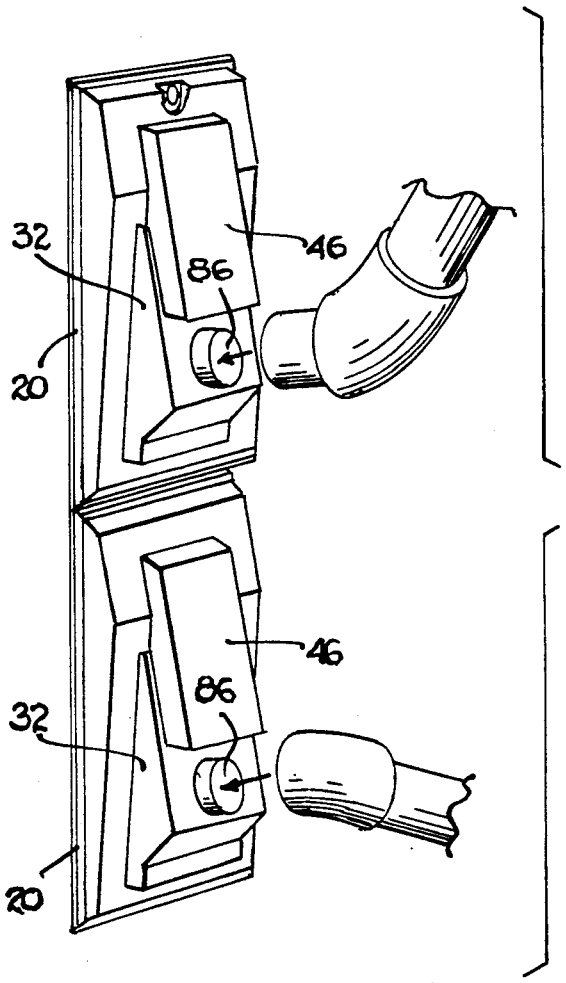
Figure 14:
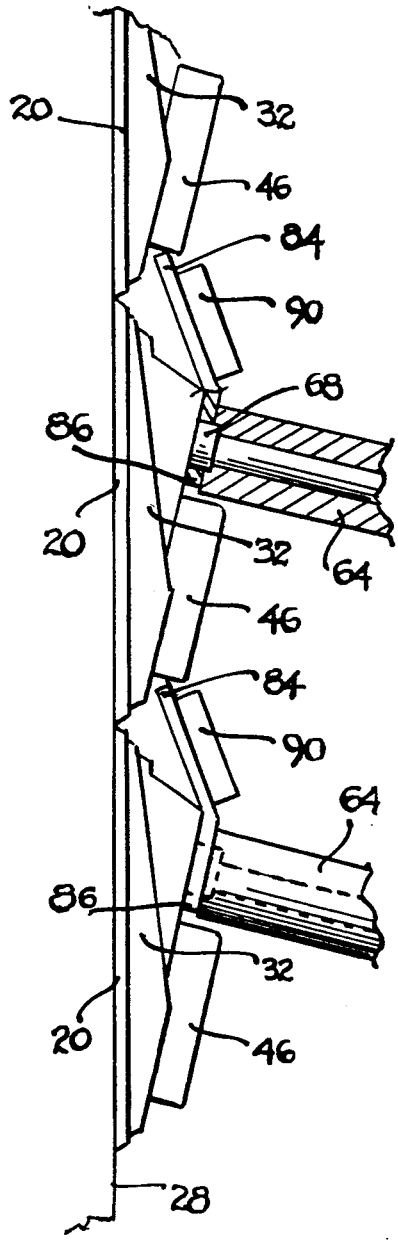
Figure 13:
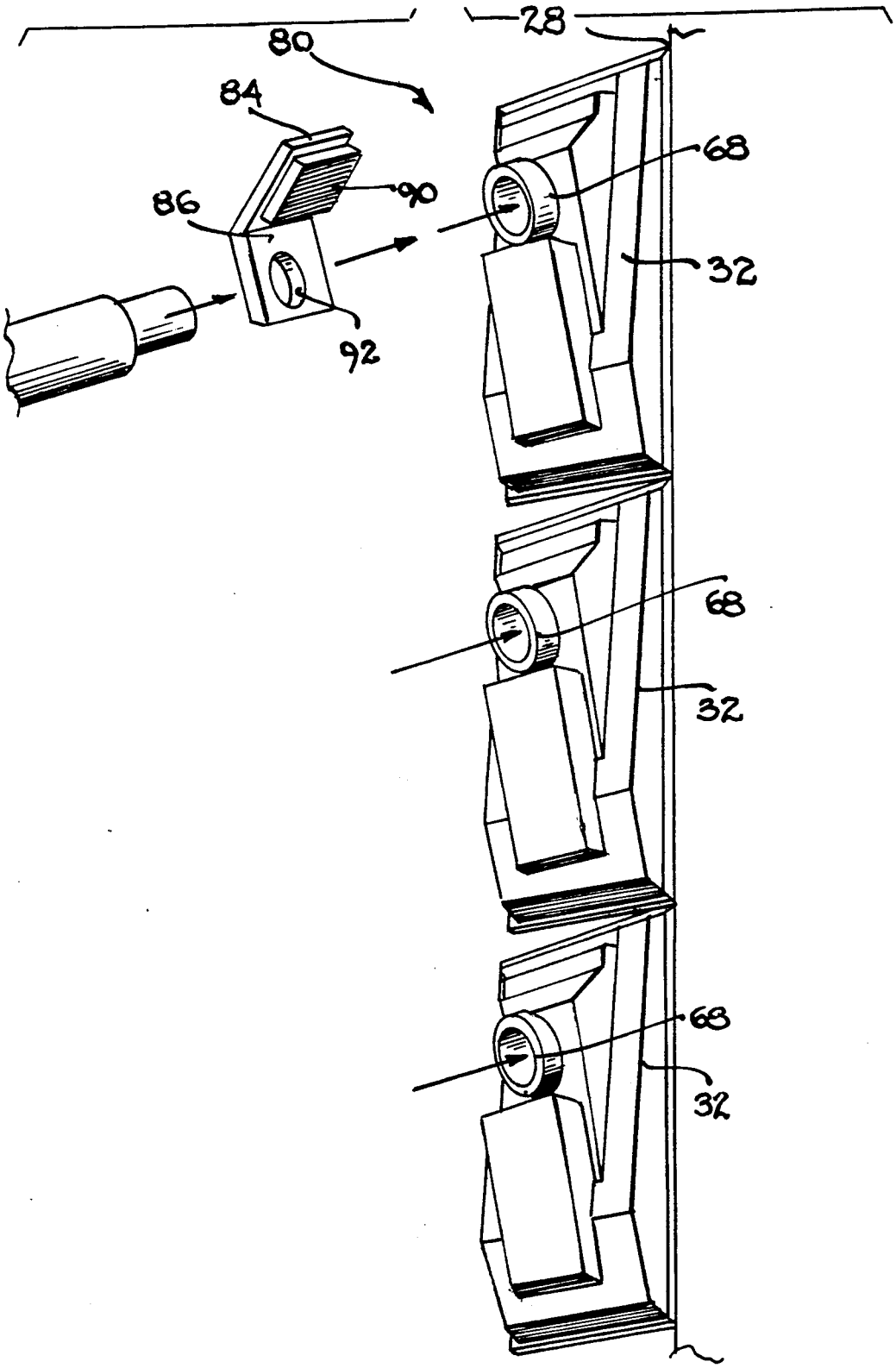

Having thus described the invention in general terms, reference will now be made to the accompanying drawings (six sheets) in which:

FIG. 1 is a perspective view of an object support rack constructed in accordance with and embodying the present invention;

FIG. 2 is a front elevational view of the object support rack;

FIG. 3 is a rear elevational view of the object support rack;

FIG. 4 is a side elevational view of the object support rack;

FIG. 5 is a top plan view of the object support rack;

FIG. 6 is a bottom plan view of the object support rack;

FIG. 7 is a fragmentary side elevational view showing the securement of a foam pad over a post forming part of the object support rack;

FIG. 8 is a fragmentary sectional view showing the securement of an end cap to a post forming part of the object support rack of the present invention;

FIG. 9 is a vertical sectional view showing a portion of a socket on the object support rack and an end of a post adapted to being fitted within that socket;

FIG. 10 is a fragmentary side elevational view of a pair of object support racks connected and vertically arranged in abutting relationship;

FIG. 11 is a fragmentary side elevational view somewhat similar to FIG. 10 and showing the use of elbow connectors forming a pair of angularly arranged post sections;

FIG. 12 is a perspective view showing the arrangement of FIG. 11 in which the posts sections can be rotated to desired angles to one another;

FIG. 13 is a exploded perspective view, partially broken away and showing an alternate embodiment of the invention which utilizes foam pads extending between vertically arranged abutting support racks;

FIG. 14 is a side elevational view of the embodiment of FIG. 13; and

Figure 15:
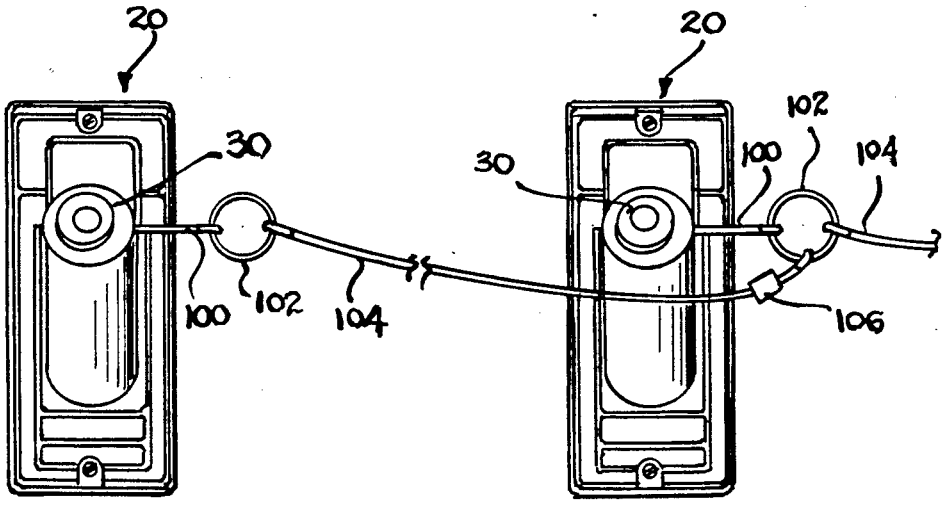

FIG. 15 is a side elevational view showing a further embodiment of the.invention which utilizes cables capable of extending between adjacent support racks.

DETAILED DESCRIPTION OF PRACTICAL EMBODIMENTS

Referring now in more detail and by reference characters to the drawings which illustrate several practical embodiments of the present invention, the support rack of the invention is more fully illustrated in FIGS. 1–6. Other embodiments of this basic support rack and systems utilizing the same are hereinafter described and illustrated in more detail.

The support rack A of the present invention comprises a mounting plate 20 having a peripherally extending rim 22. By reference to FIG. 3, it can be observed that the rim 22 is provided with a rectangularly shaped peripherally extending wall engaging surface 24. The mounting plate 20 is also provided on its opposite surface with an integrally formed somewhat trapezoidally shaped housing 26 having a rather long upwardly and outwardly inclined wall 28 merging into a shorter length downwardly and outwardly diverging wall 30. Also integrally formed with the housing 26 in the center portion thereof is an upwardly projecting raised surface 32.

The mounting plate 20 is also provided with a recessed upper mounting hole 34 and a lower recessed mounting hole 36. Each of these mounting holes 34 and 36 are sized to receive conventional mechanical fasteners, such as screws or the like. It should be understood that other forms of mounting holes could be provided in the mounting plate for receiving mechanical fasteners. However, it is preferable to have at least the one upper mounting hole 34 and one lower mounting hole 36 which are centered intermediate the opposite vertical edges of the mounting plate 20.

A mounting post 38 is secured to and extends outwardly from the raised surface 32. Moreover, by reference to FIGS. 1 and 4–6 of the drawings, it can be observed that the raised surface 32 is obliquely located with respect to the other surfaces forming part of the housing 26. Thus, the post is located at an angle other than perpendicular with respect to the flat wall mounting surface 24 and with respect to a wall on which the support rack A may be mounted. The mounting post 38 may be integrally formed with the mounting plate 20, and particularly with the raised surface 32, or otherwise, it may be removably secured thereto. For this purpose, the raised surface 32 could be provided with a cylindrically shaped outwardly projecting hub or socket 40 on which the post 38 may be mounted.

Also, in accordance with a more preferred embodiment of the present invention, the mounting post 38 is covered by an outer foam layer 42 which extends along the entire length of the cylindrically shaped post. At its outer end, the post 38 may also be provided with a removable cover pad 44. In addition, a similar protective foam pad 46 may be secured to the upper portion of the raised surface 32 in the manner as best illustrated in FIGS. 1, 2 and 4 of the drawings. In many cases, it is not necessary or even desirable to use the protective foam pad 46.

The protective pad 46 may be secured to the raised surface by means of adhesives or any other suitable fastening means. The outer foam cover 42 on the post may be in the form of a cylindrical sleeve which extends over the post. An end cap 44 may also be fitted upon the outer end of the post 38, as hereinafter described, or it may be adhesively secured thereto.

The mounting plate 20, which is often referred to as a mounting bracket, is typically formed of a suitable plastic material as for example, polyethylene, polypropylene, polystyrene or the like. Moreover, this mounting plate 20 may be formed in any of a number of conventional plastic molding operations, as for example, thermo-forming, blow molding, injection molding or the like. However, it should be understood that the mounting plate 20 could be formed of any of a number of other materials, as for example, lightweight metals such as aluminum or the like. In addition, the mounting plate, if desired, could be formed of reinforced plastic materials.

The object support rack A of the present invention can be used effectively in the manner as illustrated in FIGS. 1 and 4–6 of the drawings by securing the mounting plate 20 to a vertically disposed wall or other vertically disposed surface. In this way, the post 38 projects outwardly and upwardly therefrom in the manner as best illustrated in FIG. 1.

A pair of horizontally spaced apart support racks A are highly effective in supporting objects for display and particularly merchandisable objects. As a simple example, surfboards or similar objects can be placed upon two laterally spaced outwardly extending posts 38 and particularly on the foam covers 42 of those posts. In addition, edges of the surfboards or other objects may bear again the foam pad 46. In this way, the objects will be adequately supported but will not be marred by the object support rack and moreover, they will not mar the object support racks. Furthermore, it can be observed that a plurality of vertically spaced object support racks can be mounted in laterally spaced apart pairs so that for example, a plurality of vertically arranged surf boards can be displayed.

It should be understood that the use of a surf board as an object for the support rack has been described as being illustrative of the present invention. Clearly, the object support racks are universally designed for supporting almost any type of object which is to be displayed. In addition, they are highly effective for supporting bicycles or other sporting goods. In essence, these object support racks when used in pairs are highly effective in displaying many types of merchandise. By using the object support racks, it is possible to reduce the amount of costly store o retail display area floor space. Moreover, when objects are visibly displayed on a wall surface, they are more readily seen and observed by a potential purchaser.

These object support racks are highly effective in that they are not obtrusive and do not otherwise detract from the objects which are being displayed. However, they are highly effective in supporting an object in a desired position.

In one of the unique aspects of the present invention, it has been found that the supporting post 38 is mounted in such manner that the weight of an object is carried essentially at the apex of the supporting post 38 and the raised surface 32. Further, it has been found that substantial weight can be retained on these object support racks, even when the support racks are secured to a plaster wall or plasterboard wall surface with simple screws or toggle bolts. It has also been found that if screws were employed in a conventional rack, such as a towel rack or the like which lacked a large base area for mounting on a plaster or plasterboard wall, that same form of conventional mounting arrangement would not support the same weight as the object support rack of the present invention.

As indicated above, it is believed that this large contact surface area between the rack and the supporting wall as well as the fact that loads are carried at the apex of the post and the rack enables the use of simple mechanical fasteners such as screws or bolts or the like without the necessity of anchors and other retaining mechanisms in plaster and plasterboard walls.

The object support rack of the present invention literally supports a much greater amount of weight using simple mechanical fasteners than would be supported by a conventional rack mounted with screws on the same plaster or plasterboard wall. Although the theory is not understood, it is believed to be at least partially due to the fact that the weight is carried downwardly and inwardly toward the wall. Thus, a great deal of the weight is vertically disposed in the wall structure itself thereby enabling a pair of object support racks of the present invention to support a substantial amount of weight.

As indicated previously, it is possible to secure the mounting post 38 in such manner that it is permanently formed with the mounting plate 28 as for example, by integrally forming the outwardly extending post 38 to the mounting plate 20. FIGS. 7, 8 and 9 of the drawings illustrate more preferred constructions in securing the post to the mounting plate. In accordance with this construction, the mounting plate 20 is provided with an outwardly extending stub post 50. The stub post is provided with an interior flat strip-like projection 52 along with a resilient displacable locking tab 54 on an opposite side thereof, as best illustrated in FIG. 9. The mounting post 38 may be provided with an opening 56 located to receive the resilient locking tab 54. The post 38 may also be provided with an elongate slot 58 at its lower end opposite the aperture 56.

In accordance with the above construction, the mounting post 38 can only be received in the stub post 50 in one orientation, such that the elongate slot 58 is aligned with the projection 52. When so aligned, the displacable locking tab 54 will be biased outwardly to the position as shown in the dotted lines in FIG. 9 until the aperture 56 reaches the position of the locking tab 54. When the aperture 56 is in alignment with the locking tab 54, it will then be normally biased back into a locking position where the tab 54 will extend into the aperture 56. In accordance with this construction, the mounting post 38 can be-permanently secured to the mounting plate 20.

As indicated previously, the foam covering 42 may be in the form of a sleeve which extends over the mounting post 38. In addition, an end cap 60 may be provided for fitting over the outer end 38. In this case, the end cap has a reduced diameter inwardly projecting section 62 which fits snugly within the outer end of the mounting post. Moreover, the cap 60 may be provided with an outer foam covering 64.

It should also be understood that pairs of laterally spaced apart racks A could be mounted in an upside condition so that the post 38 extends somewhat downwardly and outwardly whereas in FIG. 1, the post extends upwardly and outwardly. In this latter arrangement, the pairs of support racks are effective in retaining other objects in which the upper surfaces thereof are to be displayed. Here again, using the example of surf boards, the underside of the boards, when bearing against the foam surfaces, create sufficient frictional contact to preclude their sliding off of the posts.

It should also be further recognized that the support racks could be mounted in various other positions, as for example, where they are longitudinally arranged in a horizontal plane. Here again, the support racks are uniquely designed so that they can be used in a wide variety of arrangements in order to obtain the optimum utilization of surface area and to provide for the best supporting arrangement for given objects.

FIGS. 10–12 illustrate another embodiment of the invention in which laterally spaced apart pairs of support racks can be arranged in vertical tiers, as shown. In addition, the embodiments of FIGS. 10–12 illustrate an arrangement where relatively short pipe sections 66 can be secured to sockets 68 mounted on the raised surface 32. These sockets 68 may be adapted to removably receive or to permanently receive the short post sections 66. An elbow 70 may be secured to the outer end of the short pipe section 66 and an additional longer pipe section 72 may also be secured to the other end of the elbow, in the manner as best illustrated in FIGS. 11 and 12. In accordance with this construction, it can be observed that a relatively sharp angle can be obtained using the various pipe sections in order to hold various types of objects on the support racks.

FIG. 12 illustrates an arrangement in which the elongate pipe section 72 can be rotated at an angle with respect to a vertical disposition. As a simple example, the elongate elbows and the elongate pipe 72 can be rotated to a position where the pipe sections 72 extend in a generally horizontal plane. This arrangement is effective in the event that substantial surface area is required to support a particular flat object. Nevertheless, essentially any angular relationship of the posts can be achieved with respect to the mounting plates.

FIGS. 13 and 14 illustrate a further embodiment of the invention in which a modified form of foam pad 80 may be employed with vertical tiers of abutting object support racks. In the embodiment as illustrated, an extended socket 68 extends outwardly from the raised surface 32 of each object support rack. The foam pad device 80 is comprised of a flat retainer sheet 84 having a hingedly connected tab 86 connected at a hinge point 88. The retainer sheet 84 is provided with a foam pad 90. The hingedly connected tab 86 is provided with an opening 92 to receive a socket 68 on a support rack located immediately therebeneath. In the embodiment as illustrated, it can be observed that the retainer sheet 84 is adapted to engage against a socket 68 on a support rack with which it is used. However, the tab will extend to the support rack immediately therebeneath and the opening 92 will receive the socket 68 on the support rack immediately therebeneath.

FIG. 15 illustrates still another embodiment of the invention utilizing object support racks similar to those of the type illustrated in FIG. 1–6 of the drawings. In this embodiment of the invention, relatively short cables 100 are connected to the outer ends of each of the posts 38 on the object support racks 20. A retaining ring 102 is secured to the outer end of each relatively short cable 100. Moreover, an elongate cable 104 is also secured to the retaining ring 102 and is provided at its outer end with a hook 106.

By reference to FIG. 15, it can be observed that two or more of these adjacent racks can be provided with cables. In this case, the hook 106 can be trained about a supported object and extend through the retaining ring 102 of the next adjacent rack. Otherwise, the hook may be used for securement to an object which is supported on the posts from the pair of object support rack. In either case, the cables have been found to be highly effective for retaining objects which might otherwise tend to slip from the object support rack.

In addition, the cables are highly effective in areas where seismic vibration, such as earthquakes and the like, might be prevalent in order to preclude the objects from falling from the support rack and creating injury or further damage. Moreover, the object support rack utilizing these cables with hooks are also effective in reducing the possibility of theft.

Thus there has been illustrated and described a unique and novel object support rack which is capable of receiving various types of objects in various orientations and which has a wide degree of versatility. The present invention thereby fulfills all of the objects and advantages which have been sought. It should be understood that many changes, modifications, variations and other uses and applications will become apparent to those skilled in the art after considering this specification and the accompanying drawings. Therefore, any and all such changes, modifications, variations, and other uses and applications which do not depart from the spirit and scope of the invention are deemed to be covered by the invention.

Having thus described the invention, what I desire to claim and secure by letters patent is:

1. A wall mounted object support rack for releasably supporting an a relatively heavy athletic-type elongate object thereon, said object support rack comprising:

(a) a plate having a wall facing wall engaging surface capable of being disposed against a wall so that the entire wall engaging surface is in engagement with a wall such that said plate can be substantially vertically disposed;

(b) a post secured to said plate and extending outwardly therefrom at an angular relationship thereto so that said post is other than in a perpendicular relationship with respect to said plate;

(c) means providing a plurality of fastener receiving apertures in said plate and at least one of which is adjacent an upper end and at least one of which is adjacent a lower end of said plate and which apertures lie in a plane passing through the apertures and the central axis of said post;

(d) said post being at an angle with respect to said plate and located with respect to said apertures where a load in the form of a relatively heavy athletic-type elongate object may be carried at the apex of the angle between the post and the plate, said plate having a sufficiently large peripheral dimension and a corresponding sufficiently large wall engaging surface which in combination with the load being carried at the apex of the angle between the post and the plate enables the object support rack to be secured to plaster or plasterboard walls with screws without anchors with sufficient gripping to support the weight of the rack and the load carried thereby, and where a post perpendicularly arranged with respect to a plate would not support an object of equal weight if supported by said screws;

(e) a first foam pad extending entirely over said post; and (f) a second foam pad on a portion of said plate in a region where an object might otherwise contact said plate so that an object supported on said object support rack will be protected against scratches or abrasions by said pad on said post and the pad on said plate.

2. A wall mounted object support rack for releasably supporting an object thereon, object support rack comprising:

(a) a plate having a wall facing wall engaging surface capable of being disposed against a wall with the entire wall engaging surface in engagement with a wall such that said plate can be substantially vertically disposed;

(b) a post secured to said plate and extending outwardly therefrom at an angular relationship thereto so that said post is other than in a perpendicular relationship with respect to said plate;

(c) means providing a plurality of fastener receiving apertures in said plate and which may receive fasteners for securement of said plate to a wall;

(d) a first foam circularly constructed pad extending entirely over said post;

(e) recess means on said plate to receive a foam pad; and (f) a relatively flat second foam pad disposed within said recess means of said plate in a region where an object might otherwise contact said plate, and where the axis of the first pad is at an angular relationship other than perpendicular with respect to said wall facing wall engaging surface and perpendicular to said second pad; so that an object supported on said object support rack will be protected against scratches or abrasions by said pad on said post and the pad on said plate.

3. The wall mounted object support rack of claim 2 further characterized in that a raised surface extends outwardly from said plate in angular relationship to said plate so that the post is perpendicular to said raised surface.

4. The wall mounted object support rack of claim 3 further characterized in that the second foam pad is on the raised surface.

5. A wall mountable object support rack for releasably supporting an object thereon, said object support rack comprising:

(a) a plate having a rear wall adapted to engage a structural wall and means to enable mounting to a substantially vertically disposed structural wall;

(b) a raised section on said plate and having a relatively flat raised surface angularly located with respect to said rear wall;

(c) a post receiving socket on said plate and extending outwardly from said raised section and sized to receive an object supporting post, said socket having an axial centerline perpendicular to said raised surface;

(d) a first object supporting post having an end provided for securement in said socket, said first object supporting post being secured to said socket so that it is positioned at an angle with respect to the plate and having a length so that the plate may be mounted to a wall in a right side up position or an upside down position and capable of supporting a first object in one position and another object in the other position;

(e) an elbow adapted for connection to an opposite end of said post; and (b) a second object supporting post adapted for securement to said elbow so that the second post may extent outwardly from said first post in angular relationship to said first post and at a different angular relationship with respect to said plate than said first post.

6. The wall mountable object support rack of claim 5 further characterized in that a raised surface extends outwardly from said plate in angular relationship to said plate so that the first post is perpendicular to said raised surface.

7. A wall mountable object support rack for releasably supporting an object thereon, said object support rack comprising:

(a) a plate having means to enable mounting to a substantially vertically disposed wall;

(b) a post receiving socket on said plate and extending outwardly from said plate and sized to receive a first object supporting post;

(c) an object supporting post having an end provided for securement in said socket;

(d) an elbow adapted for connection to an opposite end of said post; and (e) a second post adapted for securement to said elbow so that the second post may extend outwardly from said first post in angular relationship to said first post and at a different angular position with respect to said plate than said first post.

8. The wall mountable object support rack of claim 7 further characterized in that said object support rack comprises:

(a) a first foam pad extending entirely over said post; and (b) a second foam pad on a portion of said plate in a region where an object might otherwise contact said plate so that an object supported on said object support rack will be protected against scratches or abrasion by said pad on said post and the pad on said plate.

9. The wall mountable object support rack of claim 7 further characterized in that said object supporting post is secured to said socket so that it is positioned at an angle with respect to said plate and has a length so that the plate may be mounted to a wall in a right side up position or in an upside down position and is capable of supporting a first object in one position and another object in the other position.

10. The wall mountable object support rack of claim 7 further characterized in that a raised surface extends outwardly from said plate in angular relationship to said plate so that the post is perpendicular to said raised surface.

11. The wall mountable object support rack of claim 10 further characterized in that said post receiving socket projects from said raised surface and receives said post.

12. A system of object support racks for releasably supporting a plurality of objects and with each rack capable of supporting a separate object, said system comprising:

(a) a plurality of object support racks with each having a plate with an upper edge and lower edge;

(b) means associated with each of said plates to enable said plates to be secured to a wall surface so that the racks are vertically disposed and so that each of the racks are vertically arranged relative to one another with the upper margin of one of the racks abutting the lower margin of the rack immediately thereabove;

(c) a post secured to each plate and extending outwardly therefrom at an angular relationship thereto so that the plate is at other than a perpendicular relationship with respect to each said plate;

(d) a foam pad extending over the post on each said plate; and (e) an insert pad adapted for securement to one plate and also adapted to extend over and be engaged by a next adjacent and abutting plate so that an object will not be marred or scratched by any of such racks.

13. The system of object support racks of claim 12 further characterized in that said post is at an angle with respect to said plate, said plate having a sufficiently large peripheral surface area adapted for contact with a wall surface and where the angle of the post and a load which may be carried at the apex of the angle between the post and the plate enables the object support rack to be secured to plaster or plaster board walls with screws or bolts without anchors and where a conventional and perpendicularly arranged arm would not support an object of equal weight if supported by said screws.

14. The system of object support racks as claimed in claim 12 further characterized in that said post extends outwardly from said plate at an angle varying between about 15 degrees to about 40 degrees.

15. The system of object support racks as claimed in claim 12 further characterized in that a raised surface extends outwardly from said plate in angular relationship to said plate so that the post is perpendicular to said raised surface.

16. The system of object support racks as claimed in claim 15 further characterized in that a socket projects from said raised surface and receives said post.

17. A system of object support racks for releasably supporting a plurality of objects and with each rack capable of supporting a separate object, said system comprising:

(a) a plurality of object support racks with each having a plate with an upper edge and lower edge;

(b) means associated with each of said plates to enable said plates to be secured to a wall surface so that each of the racks are arranged relative to one another;

(c) a post secured to each plate and extending outwardly therefrom at an angular relationship thereto so that the plate is at other than a perpendicular relationship with respect to each said plate;

(d) a cable secured to each post and extending outwardly therefrom; and (e) a hook on each cable for attachment to another support rack or as an object supported thereon.

18. The system of object support racks as claimed in claim 17 further characterized in that the cables extend from the outer ends of said posts.

19. A wall mountable object support rack for releasably supporting an object thereon, said object support rack comprising:

(a) a plate having means to enable mounting to a substantially vertically disposed wall;

(b) a post receiving socket on said plate and extending outwardly from said plate and sized to receive an object supporting post;

(c) a first object supporting post having an end provided for securement in said socket, said object supporting post being secured to said socket so that it is positioned at an angle with respect to the plate and having a length so that the plate may be mounted to a wall in a right side up position or an upside down position and capable of supporting a first object in one position and another object in the other position;

(d) an elbow adapted for connection to an opposite end of said post; and (e) a second object supporting post adapted for securement to said elbow so that the second post may extend outwardly from said first post in angular relationship to said first post and at a different angular relationship with respect to said plate than said first post.

20. A wall mountable object support rack for releasably supporting an object thereon, said object support rack comprising:

(a) a plate having means to enable mounting to a substantially vertically disposed wall;

(b) a post receiving socket on said plate and extending outwardly from said plate and sized to receive an object supporting post;

(c) an object supporting post having an end provided for securement in said socket, said object supporting post being secured to said socket so that it is positioned at an angle with respect to the plate and having a length so that the plate may be mounted to a wall in a right side up position or an upside down position and capable of supporting a first object in one position and another object in the other position;

(d) extension means adapted for connection to an opposite end of said post; and (e) said extension means having a section extending outwardly from said post and which may be in a different angular relationship with respect to said plate than said post to hold another object in a different position.

21. A wall mounted object support rack for releasably supporting an object thereon, said object support rack comprising:

(a) a plate having a wall facing wall engaging surface capable of being disposed against a wall with the entire wall engaging surface in engagement with a wall such that said plate can be substantially vertically disposed;

(b) a raised surface extending outwardly from said plate in angular relationship to said plate;

(c) a socket projecting inwardly from said raised surface;

(d) a post having an end located in said socket and extending outwardly from said plate in perpendicular relationship to said raised surface and so that said post is other than in a perpendicular relationship with respect to said plate;

(e) means providing a plurality of fastener receiving apertures in said plate and which may receive fasteners for securement of said plate to a wall;

(f) a first foam circularly constructed pad extending entirely over said post;

(g) recess means on said plate to receive a foam pad; and (h) a relatively flat second foam pad disposed within said recess means of said plate in a region where an object might otherwise contact said plate, and where the axis of the first pad is at an angular relationship other than perpendicular with respect to said wall facing wall engaging surface and perpendicular to said second pad; so that an object supported on said object support rack will be protected against scratches or abrasions by said pad on said post and the pad on said plate.

22. The wall mounted object support rack of claim 21 further characterized in that means is associated with said socket and an end of said post so that said post can be locked in said socket.

* * * * *